US009857129B1

(12) United States Patent
Kelly et al.

(10) Patent No.: US 9,857,129 B1
(45) Date of Patent: Jan. 2, 2018

(54) GAS ADJUSTMENT SYSTEM FOR A FIREARM BOLT CARRIER

(71) Applicant: 2A Armament, LLC, Boise, ID (US)

(72) Inventors: Brian L. Kelly, Boise, ID (US); Ryan Jacobson, Kuna, ID (US); Bryan R. Tucker, Nampa, ID (US); Ben L. Chuckovich, Boise, ID (US); William W. Schanz, Boise, ID (US)

(73) Assignee: 2A ARMAMENT, LLC, Boise, ID (US)

( * ) Notice: Subject to any disclaimer, the term of this patent is extended or adjusted under 35 U.S.C. 154(b) by 0 days.

(21) Appl. No.: 14/990,234

(22) Filed: Jan. 7, 2016

Related U.S. Application Data

(60) Provisional application No. 62/101,004, filed on Jan. 8, 2015.

(51) Int. Cl.
*F41A 5/28* (2006.01)

(52) U.S. Cl.
CPC ..... *F41A 5/28* (2013.01)

(58) Field of Classification Search
CPC ..... F41A 5/28
USPC ..... 89/193
See application file for complete search history.

(56) References Cited

U.S. PATENT DOCUMENTS 8,991,295 B2 3/2015 Larue
9,341,423 B2 * 5/2016 McGinty ..... F41A 15/14
9,372,038 B1 * 6/2016 Sylvester ..... F41A 5/24
2013/0098235 A1 * 4/2013 Reinken ..... F41A 5/28 89/193
2015/0226502 A1 8/2015 Beaty
2015/0241149 A1 8/2015 McMillen
2015/0323270 A1 11/2015 Winge et al.

OTHER PUBLICATIONS

GEMTECH "5.56 Suppressed Bolt Carrier". Product Data [online]. [retrieved on Dec. 29, 2015]. Retrieved from the Internet: <URL: http://www.gem-tech.com/store/pc/GEMTECH-5-56-Suppressed-Bolt-Carrier-55p1149.htm>.

* cited by examiner

*Primary Examiner* — Reginald Tillman, Jr.
(74) *Attorney, Agent, or Firm* — Your Intellectual Property Matters, LLC; Robert A. Frohwerk

(57) ABSTRACT

This Regulated Bolt Carrier is a lightweight carrier having a built-in gas regulating gate. As a drop-in assembly it enables tuning of the gas system used in firearms of the AR-15 class. Adjustments of a continuously variable nature may be made quickly through the port door without requiring disassembly of the firearm. A gas "regulator gate" located under the gas key below a gas port inside the body of the bolt carrier itself is cut as a half-moon. Rotating the regulator gate on its axis changes the position of the half-moon cutout, blocking the entry of gas into the system. The regulator gate can be set anywhere from fully open to fully closed and is held in position by a small lock screw. For maintenance, the gas regulator gate can be pushed out of its bore via an access hole on the opposite side of the bolt carrier.

12 Claims, 7 Drawing Sheets

GAS ADJUSTMENT SYSTEM FOR A FIREARM BOLT CARRIER

CROSS-REFERENCES TO RELATED APPLICATIONS

This application claims benefit of U.S. Provisional Application No. 62/101,004 filed Jan. 8, 2015, entitled "Gas Piston Adjustment System for the AR-15/AR-10 Bolt Carrier", which is incorporated here by reference in its entirety.

FIELD OF THE INVENTION

The present application relates generally to firearms. More specifically, this application describes a mechanism operated by propellant charge energy to automatically open a bolt lock using an adjustable bleed of gas pressure from the barrel.

BACKGROUND OF THE INVENTION

One standard gas system used in AR-15 rifles is commonly referred to as Direct Impingement (DI). When a cartridge is fired, a portion of the expanding propellant gas is directed out of a gas port in the barrel through a gas tube and back into the upper receiver. As the gas then enters the bolt carrier through a gas key the bolt carrier is forced to the rear, unlocking the bolt. Thus, the cycling process begins, with the bolt ejecting the spent cartridge in preparation for acceptance of another shell.

Gases released through the bolt carrier serve to offset recoil and other impact forces in the firearm, subject to barrel length and bolt carrier weight. Additional variations due to ammunition will affect performance as a given amount of gas is directed back into the bolt carrier. Performance of the firearm in the ejection of spent shells may be tuned by controlling the amount of gas in the loop. A variety of solutions exist for regulating the amount of gas used in the system, most of which include an adjustable gas block on the barrel.

BRIEF SUMMARY OF THE INVENTION

When a gas-driven firearm is discharged, a portion of the munitions gases are directed from a hole in the barrel into a gas block directing the gas back into the bolt carrier. Performance of a particular firearm may be adjusted by controlling the amount of gas that is so directed.

The Regulated Bolt Carrier described here enables performance tuning of a continuously variable nature and allows it to be done quickly through the port door without requiring any disassembly of the firearm. A Gas Gate, located within the bolt carrier under the gas key, may be cut in a variety of shapes so that rotation on its axis either allows or blocks entry of gas into the system. After the gate is set by a user for a particular level of performance, it is held in the desired position by a simple locking device.

BRIEF DESCRIPTION OF THE DRAWINGS

Particular features and advantages will become apparent from the following description taken in conjunction with one or more of the accompanying FIGS. 1-11 of the drawings.

The following Reference Numbers may be used in conjunction with one or more of the accompanying FIGS. 1-11 of the drawings:

10 Rifle of AR-15 class
20 Upper Receiver
30 Gas Block
40 Gas Tube
50 Gas Port
60 Gas Key
80 Gas Path
100 Regulated Bolt Carrier (RBC)
120 Bolt
125 Gas Ring
130 Bolt Chamber
140 Regulator Gate, Adjustment Valve
150 Regulator Gate Lock Screw
170 Ejection Port Opening
180 Port Door, Ejection Port Cover
190 Exhaust Port

DETAILED DESCRIPTION OF THE INVENTION

Discharging a firearm causes the loaded projectile to be propelled through the barrel under influence of the pressure developed by the munitions gases. It is common in automatic and semiautomatic reloading firearms for a portion of the munitions gases to be tapped from a hole in the barrel and redirected through a gas block attached to the barrel. A gas tube then routes the gas back into the top of the bolt carrier. Such systems are commonly referred to as Direct Impingement (DI) systems since forces are transmitted directly to the bolt using the fluid pressure of the gas without any intervening mechanical pistons.

The release of expelled gases through the bolt carrier acts to mitigate forces of the bolt carrier in the system. These forces can be observed as recoil forces and as impact forces on the buffer tube and buffer tube springs in the firearm. Variations in ammunition may result in a range of gas pressures within a given system. Options for interchangeable bolt carriers, especially with the trend towards lighter weight bolt carriers, will affect performance as a given amount of gas is directed back into the bolt carrier. A firearm that allows for adjustment of the amount of gas permitted into the system can be tuned for preferred operating conditions with respect to observed forces, for spent shell ejection performance and reload cycle rate.

Figure 1:
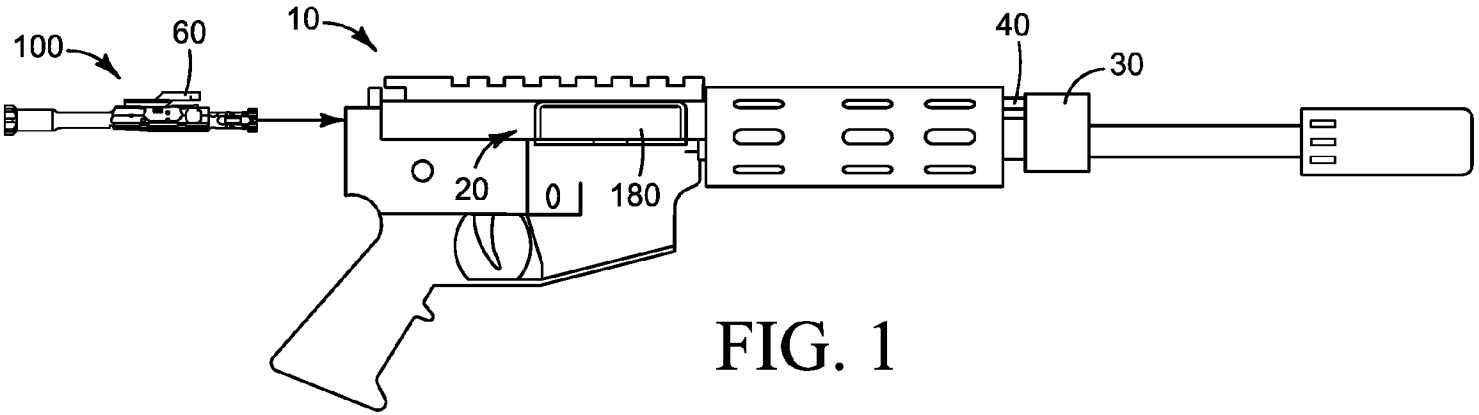
FIG. 1 indicates a Regulated Bolt Carrier (RBC) ready for insertion to an AR-15 rifle.

The presently described design facilitates the adjustment for optimal performance of a gas piston driven system such as that used in firearms based on the AR-15 and AR-10 platform as depicted in FIG. 1. A firearm 10 of this class will have a gas block 30 mounted to the barrel. Following discharge of the firearm a portion of the propellant gases from the discharged munitions is bled off of the barrel at the gas block 30 and routed through a gas tube 40 which extends rearward from the gas block.

Figure 2:
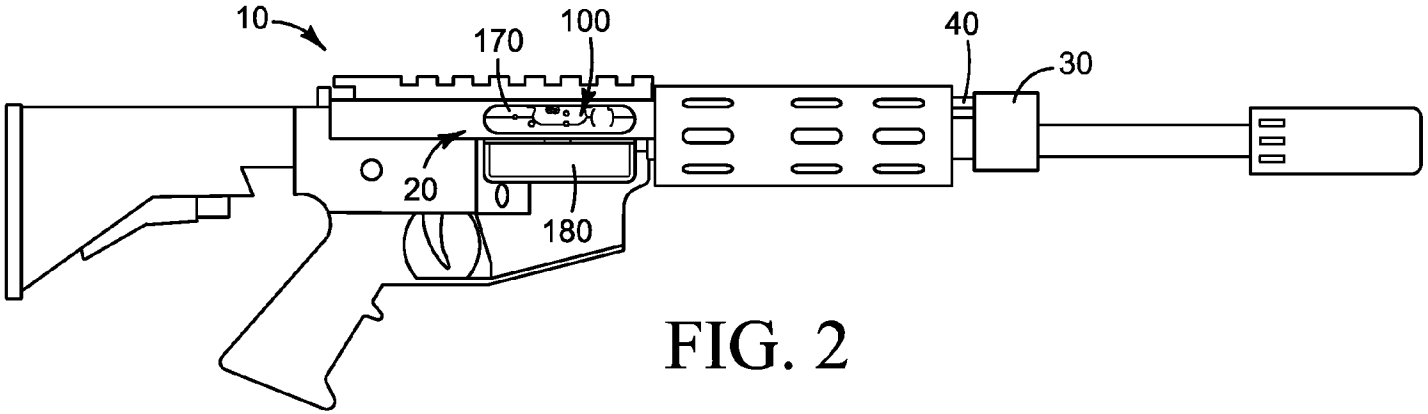
FIG. 2 shows the Regulated Bolt Carrier (RBC) in position within an AR-15 rifle.

A bolt carrier is inserted into the upper receiver 20 of the firearm. Insertion of a Regulated Bolt Carrier (RBC) 100 of the present design results in a configuration as shown in FIG. 2 wherein opening of the Port Door 180, also known as an Ejection Port Cover, exposes the regulation controls as being readily accessible through the Ejection Port Opening 170.

Figure 8A:
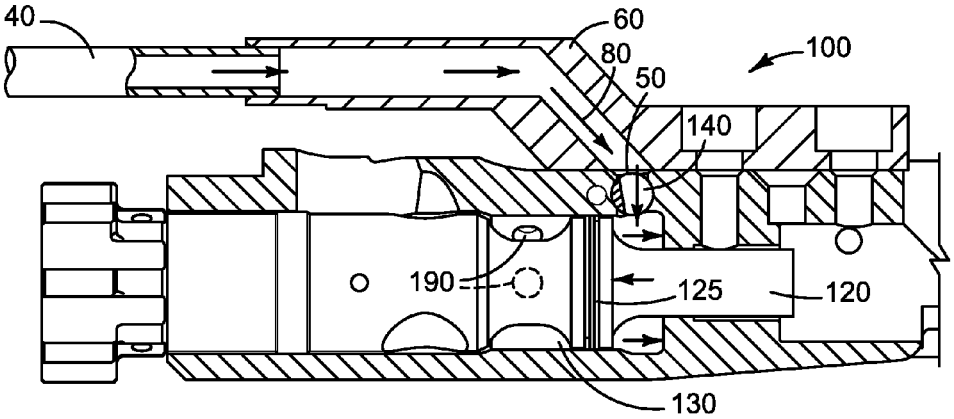
FIGS. 8A-8C depict gas flow paths within the RBC.
Figure 8B:
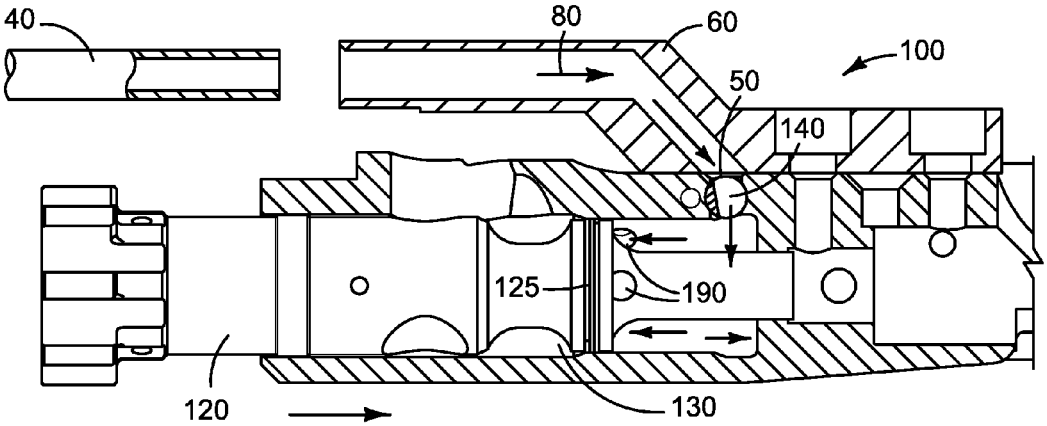
Figure 8C:
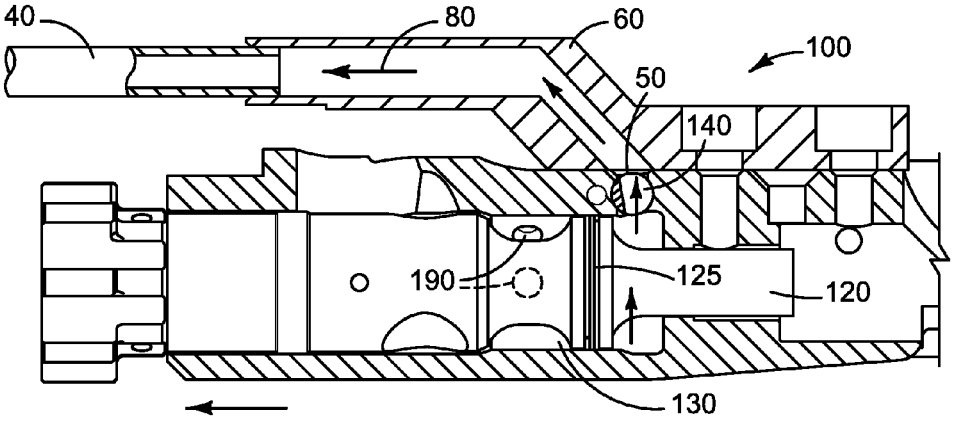

When the RBC 100 is fully seated, a Gas Key 60 mounted to an upper surface of the RBC is coupled to the gas tube 40. Gas from the gas tube enters the Gas Key 60 which routes the gas to the Gas Port 50 at the top of the RBC, as best seen in FIG. 8A-8C. A Gas Path 80 provides fluidic communication through the Regulator Gate 140 into the Bolt Chamber 130 where the gas is trapped by a set of three Gas Rings 125 on the Bolt 120. This drives the body of the RBC 100 backward relative to the munition that was chambered. The RBC continues to travel until it is far enough back relative to the Bolt 120 to expose the holes of the Exhaust Port 190. The Exhaust Port will exhaust the gas that has been allowed into the RBC to relieve some of the gas pressure.

The maximum distance of travel between the Bolt 120 and the Regulated Bolt Carrier 100 is limited and once the limit is reached the entire assembly travels backward to eject the spent cartridge and load the next round. By controlling the action of the Regulated Bolt Carrier (RBC) the Regulator Gate 140 controls the impact of the RBC and consequently the amount of recoil in the system, as well as the reliable ejection of the spent shell.

As the Regulated Bolt Carrier travels backward the Gas Key 60 is decoupled (FIG. 8B) from the Gas Tube 40. At this point the gas flow reverses direction within the Gas Path 80 as excess gas is vented back out of the Gas Key and through a cut in the face of the Upper Receiver 20 until the gas pressures dissipate.

As previously mentioned, venting also takes place through the Exhaust Port 190 behind the Port Door (Ejection Port Cover 180) after the Bolt 120 has completed the extent of its rotation and forward movement to eject and reload (FIG. 8C). Adjusting the Regulator Gate 140 to limit travel of the Bolt 120 to only what is necessary to operate reduces the amount of gas flowing into the Bolt Chamber 130. This causes a reversal in the direction of gas flow and increases venting back through the Gas Key 60.

Figure 4:
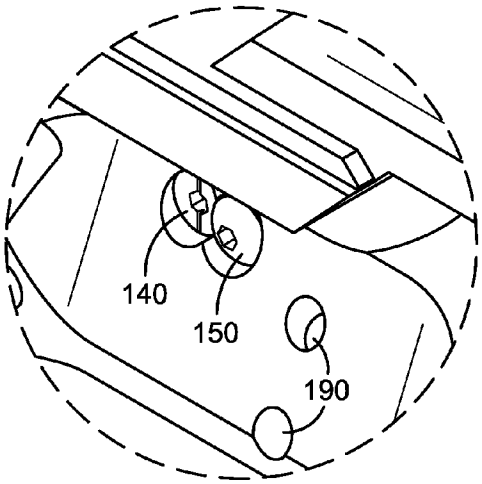
FIG. 4 is a detail to show location of critical elements within the RBC.
Figure 3:
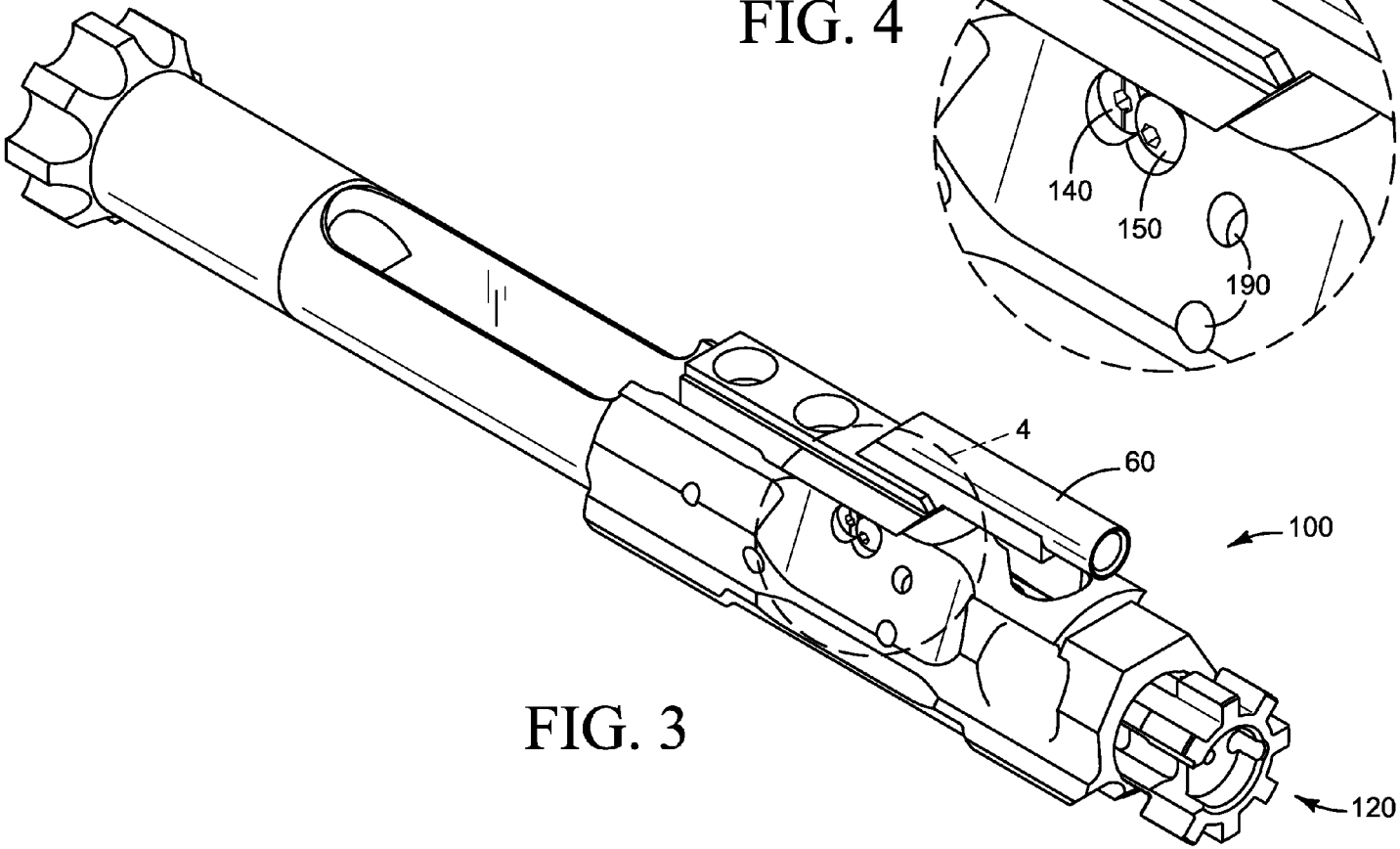
FIG. 3 is a perspective view of the RBC.
Figure 5:
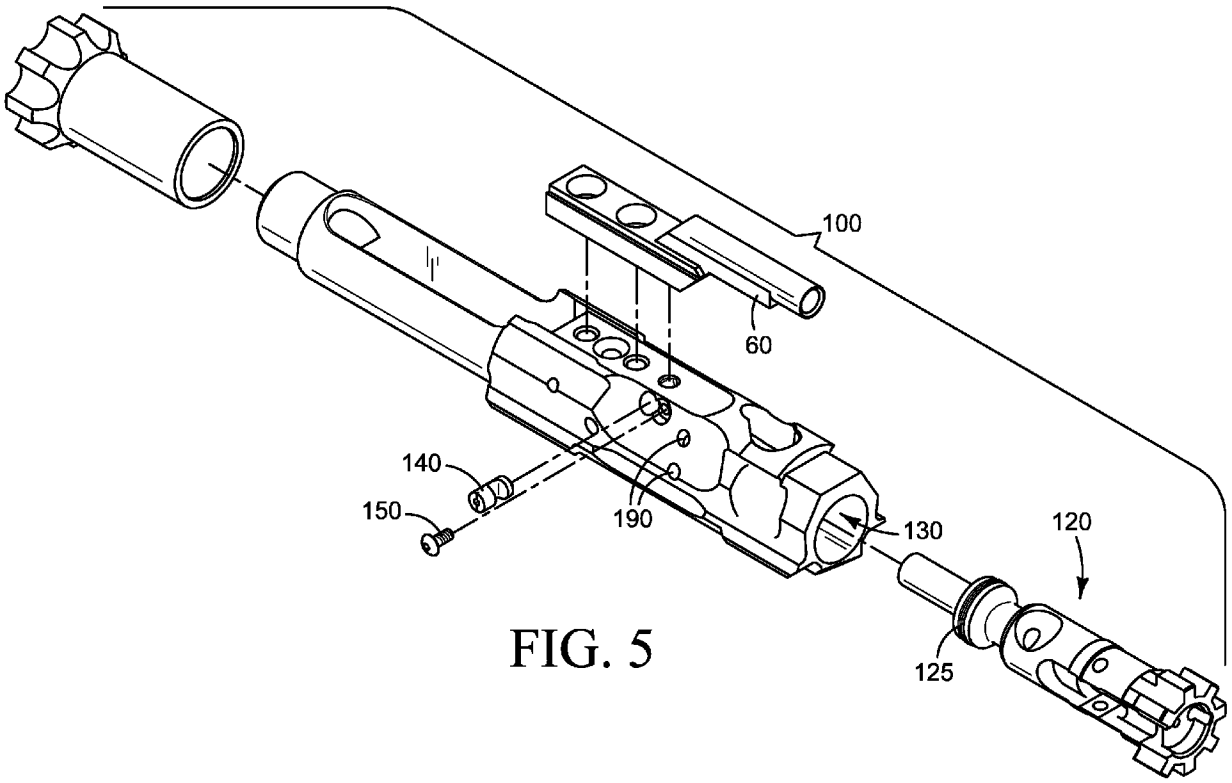
FIG. 5 is an exploded view of the RBC and related elements.
Figure 6:
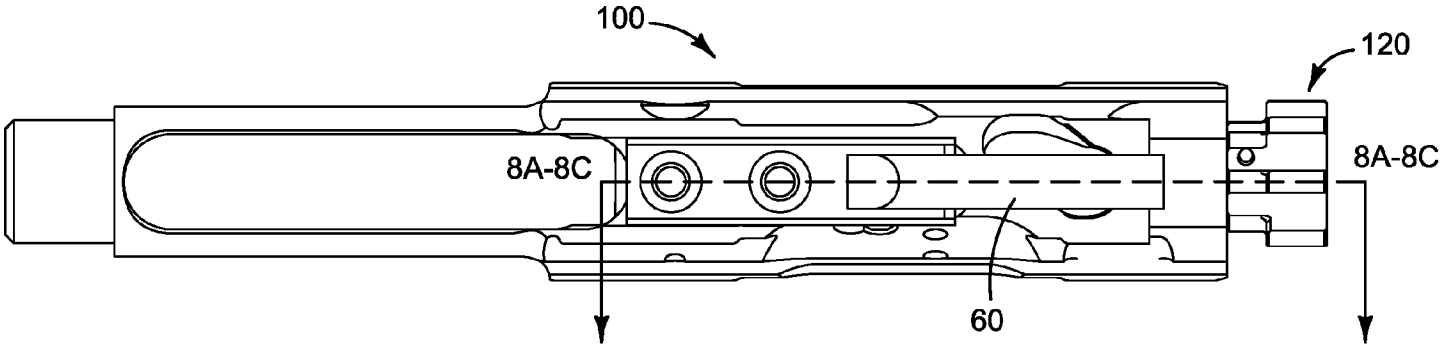
FIG. 6 is a top plan view of the RBC.
Figure 7:
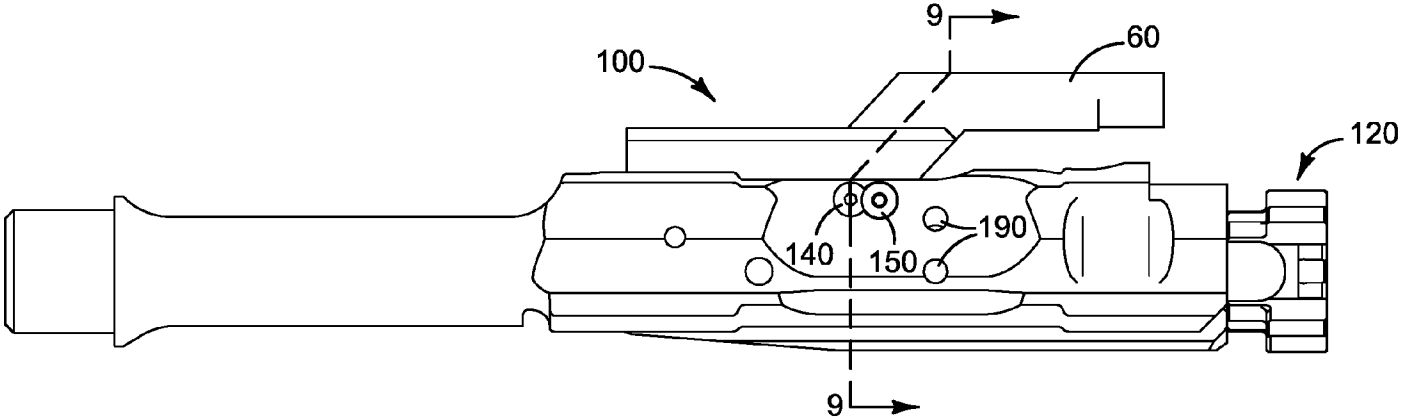
FIG. 7 shows a side view of the RBC.

At the heart of the Regulated Bolt Carrier (RBC) 100 is the Regulator Gate 140 with an optional companion Regulator Gate Lock Screw 150, shown in FIG. 3 with detail in FIG. 4, and additional views in FIGS. 5, 6 and 7. The RBC serves as a housing so as to position the integral regulating components to be accessible through the ejection port as was seen in FIG. 2.

Figure 9:
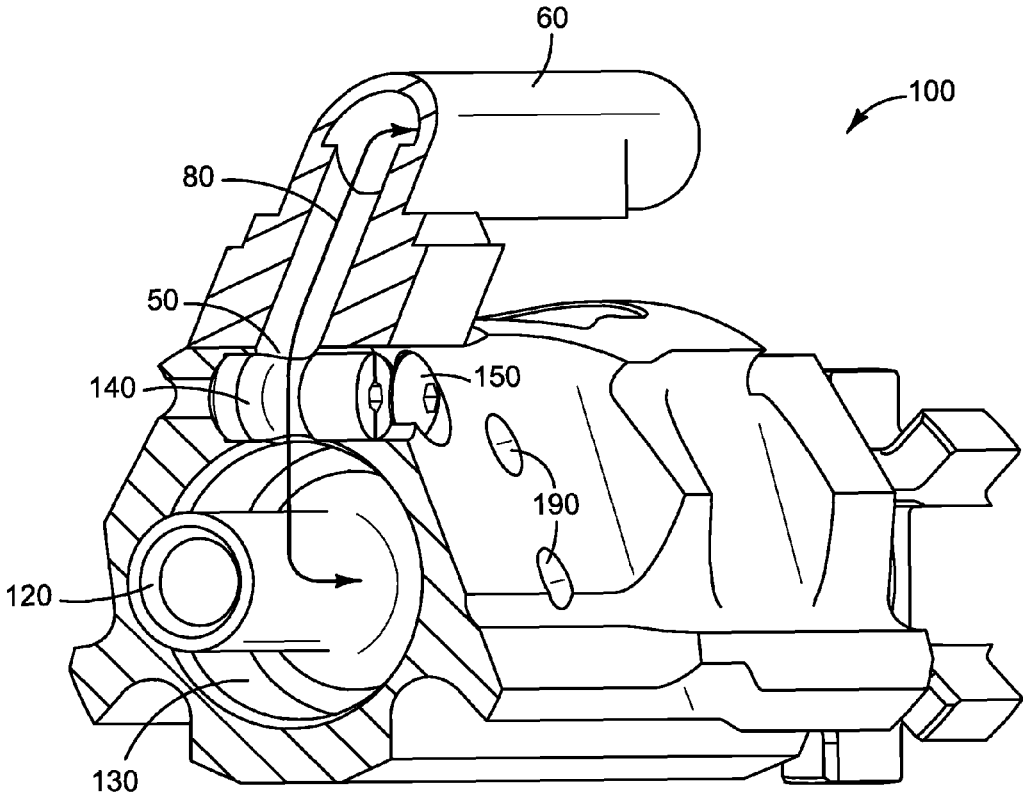
FIG. 9 is a cutaway view depicting gas flow past the Regulator Gate.

Referring to FIG. 9, the Regulator Gate 140 serves as an adjustment valve to control the amount of gas that is directed into the Regulated Bolt Carrier 100 and the Bolt 120. This rotary action valve provides for a continuously variable adjustment through an entire 360° of rotation to give a user complete control of the Gas Path 80 from fully opened to fully closed, that is, from no interruption to completely blocked. In the present context, the gas system may be adjusted from Unsuppressed to fully Suppressed.

The Regulator Gate 140 is, in general, a cylinder with a side cutout, shaped such as a flat or with a half-moon profile, acting as a ball valve. It is seated in a tightly toleranced bore to minimize leakage of high pressure gas around the gate, and can be pushed out of its bore for cleaning via an access hole on the opposite side of the Regulated Bolt Carrier 100.

Figure 10:
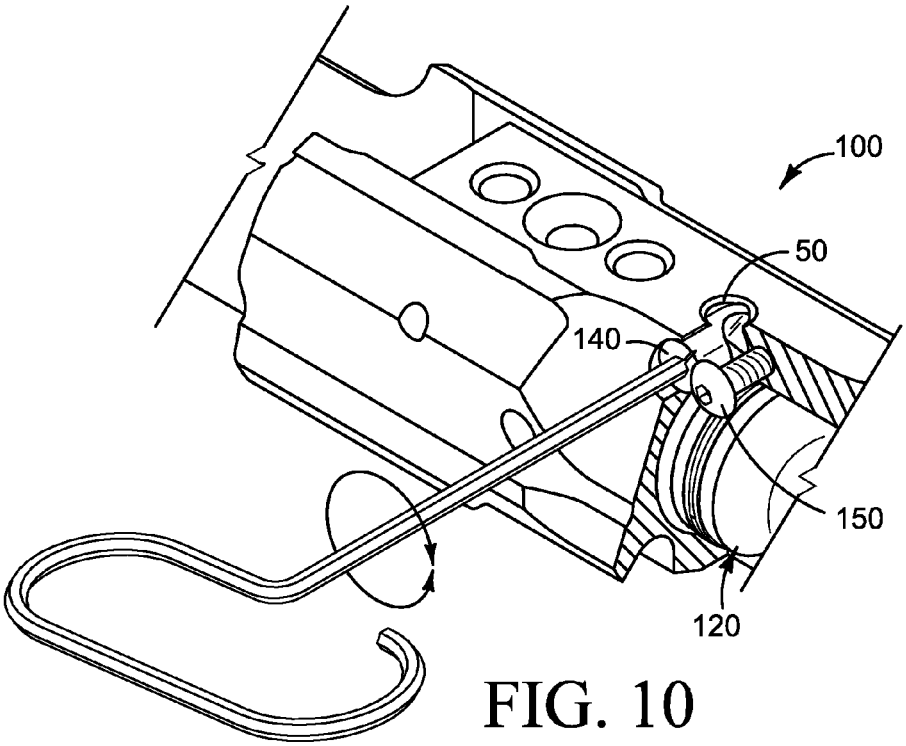
FIG. 10 depicts adjustment of the Regulator Gate.
Figure 11:
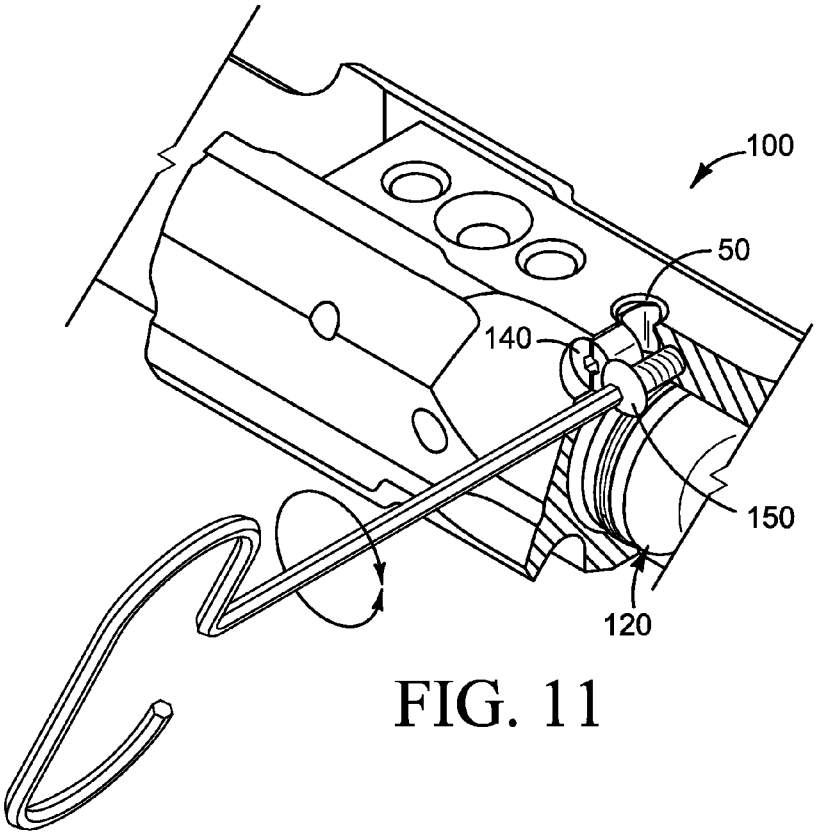
FIG. 11 depicts setting of the Lock Screw.

The Regulator Gate 140 is easily adjusted, effectively in real-time, by access through the Port Door 180 without disassembling the firearm in any manner. Opening the Port Door reveals the Regulator Gate 140 of the Regulated Bolt Carrier 100, exposing it for adjustment as shown in FIG. 10. Adjustment is made by simply turning with a readily available wrench.

A lock screw, serving as a retention device, is threaded into the RBC parallel to the axis of the Regulator Gate 140 and offset from it such that a head of the lock screw overlaps an exposed portion of the Regulator Gate 140. When the user has achieved a satisfactory adjustment of the Regulator Gate, the same wrench is moved to the Regulator Gate Lock Screw 150 which is tightened by turning clockwise (FIG. 11) to hold the Regulator Gate in position. The Port Door is then closed before firing the next round. Readjustment of the Regulator Gate merely requires a user to reopen the Port Door, loosen the Regulator Gate Lock Screw by turning counterclockwise, make the desired adjustment, retighten the Lock Screw, and close the Port Door.

Given the ease of adjustment of the present design, one might easily overlook the fact that, among configurations that are adjustable, essentially all other designs require the bolt carrier to be removed from the upper receiver in order to make any adjustment. Using the present design, adjustment is easily accomplished with the bolt carrier in its position for operation.

Often gas adjustment is accomplished on the gas block which is typically attached at about mid-length of the barrel. Locating the adjustment on the bolt carrier not only makes the adjustment more accessible, but also moves the adjustment further away from immediate contact with the barrel. This helps to reduce particulate buildup, alleviates concerns about corrosion, and reduces the need for cleaning.

In addition to its location the orientation of the Regulator Gate within the Regulated Bolt Carrier (RBC) offers advantages beyond ease of adjustment. Since the body of the Regulated Gate is oriented with its axis perpendicular to the flow of gas, it will not "back out" due to vibration of repeated firings. This overcomes a problem which occurs with designs that utilize a gate that is threaded into the gas flow path wherein a tip of the threaded gate obstructs the gas flow, an example of which is U.S. Patent Application Publication 2015/0241149 to McMillen for "Adjustable Gas Key for Autoloading Firearm".

In 2015 GEMTECH (Boise, Id.) introduced a Suppressed Bolt Carrier for use with some direct gas impingement rifles. It purports to allow a shooter to select either a suppressed or an unsuppressed setting, with no intermediate adjustment being provided, without any permanent modifications to the firearm. However, selection of one or the other setting requires an inconvenient removal of the bolt carrier from the upper receiver.

Beyond location and orientation, the presently described inline, pass-through gate allows passage of debris even when partially restricted. The shape of the gate itself tends to minimize turbulence as gas flows smoothly past the gate. This reduces dead space where residue may accumulate.

The components and methods described here can be adapted to any firearm based on a gas piston driven system, not just those based upon the AR-15 or AR-10 platforms. Since the described regulator system can only regulate the amount of exhaust gas delivered to it, insufficient exhaust gas in the system may limit adjustments to a less than favorable condition. If the gas supplied by a given system is found to be insufficient for desirable regulation, adjustments may be made upstream by resizing the orifice of the barrel-mounted gas block, or the load may be adjusted in the ammunition.

The intent of the methods described here is to provide a firearm user with a convenient means to adjust the force of recoil of a bolt carrier at the bolt carrier. The method also provides for easily repeating the adjustment to achieve a proper ejection pattern of expired shells from the firearm.

It will be recognized by those skilled in these and related arts that many variations of the described embodiments are possible. The regulator gate may be reconfigured to operate in a linear rather than rotary manner. Such alternatives include a sliding gate or orifice plate where gas flow is controlled by inserting or retracting a slide into a channel in the bolt carrier. Such a gate may present a solid face against the gas flow, or it may have a shaped or tapered cut out. Positioning of a gate may be aided by adding detents to provide tactile feedback during adjustment.

What is claimed is:

1. A system for regulating gas flow in a gas-driven firearm, the system comprising:
- a bolt carrier;
- a bolt chamber within the bolt carrier;
- a gas port; and
- a regulator gate,
- wherein the regulator gate is in a gas flow path between the gas port and the bolt chamber, and
- wherein the regulator gate includes a cylinder having a cut out that presents a half-moon profile to the gas flow path, and
- wherein the regulator gate is continuously adjustable through an entire 360° of rotation and lockable in any position to incrementally regulate a flow of gas over a range from no interruption to fully blocked without any disassembly of the gas-driven firearm.

2. The system of claim 1, further comprising:
- an upper receiver having an ejection port opening,
- wherein the bolt carrier is slidably mounted within the upper receiver, and
- wherein the regulator gate is adjustable through a single ejection port opening.

3. A regulated bolt carrier for use with a firearm, the regulated bolt carrier comprising:
- a gas port;
- a bolt chamber;
- an exhaust port;
- a first gas path providing fluidic communication between the gas port and the bolt chamber;
- a second gas path providing fluidic communication between the bolt chamber and the exhaust port; and
- a regulator gate intersecting the first gas path,
- wherein the regulator gate includes a cylinder having a cut out that presents a half-moon profile to the first gas path, and
- wherein the regulator gate is continuously adjustable through an entire 360° of rotation and lockable in any position to incrementally regulate a flow of gas over a range from no interruption to fully blocked by access through a single ejection port opening of the firearm.

4. The regulated bolt carrier of claim 3, wherein the regulator gate is adjustable to regulate a flow of gas in the first gas path.

5. The regulated bolt carrier of claim 3, further comprising a retention device, wherein the retention device prevents the regulator gate from being dislodged or inadvertently readjusted.

6. The regulated bolt carrier of claim 5, wherein the retention device is a lock screw.

7. The regulated bolt carrier of claim 6, wherein the lock screw is positioned so that a head of the lock screw overlaps an exposed portion of the regulator gate to which it applies pressure to prevent the regulator gate from being dislodged or inadvertently readjusted.

8. A firearm comprising:
- an upper receiver; and
- a regulated bolt carrier, wherein the regulated bolt carrier includes:
  - a bolt chamber;
  - a gas port; and
  - a regulator gate positioned in a gas flow path between the gas port and the bolt chamber,
- wherein the regulated bolt carrier is slidably mounted within the upper receiver, and
- wherein the upper receiver includes an ejection port opening, and
- wherein the regulator gate provides a continuously variable adjustment from no interruption of the gas flow path to completely blocking the gas flow path and the continuously variable adjustment is accomplished through a single ejection port opening.

9. The firearm of claim 8, wherein the regulator gate comprises a ball valve that provides a continuously variable adjustment through an entire 360° of rotation.

10. The firearm of claim 8, wherein the regulator gate comprises a cylinder having a cut out that presents a half-moon profile to the gas flow path, and
- wherein the regulator gate provides a continuously variable adjustment through an entire 360° of rotation.

11. A system for regulating gas flow in a gas-driven firearm, the system comprising:
- a bolt carrier;
- a bolt chamber within the bolt carrier;
- a gas port; and
- a regulator gate,
- wherein the gas-driven firearm includes an upper receiver having an ejection port opening, and
- wherein the regulator gate is in a gas flow path between the gas port and the bolt chamber, and
- wherein the regulator gate is continuously adjustable to incrementally regulate a flow of gas over a range from no interruption to fully blocked, and
- wherein the bolt carrier is slidably mounted within the upper receiver, and
- wherein the regulator gate is continuously adjustable and lockable in any position through a single ejection port opening.

12. The regulated bolt carrier of claim 3, further comprising a tail fin, wherein the tail fin is separable from a regulated bolt carrier body.

* * * * *